US010960428B2

(12) United States Patent
Andersen

(10) Patent No.: US 10,960,428 B2
(45) Date of Patent: Mar. 30, 2021

(54) WATER FOUNTAIN

(71) Applicant: Sean P. Andersen, Phoenix, AZ (US)

(72) Inventor: Sean P. Andersen, Phoenix, AZ (US)

( * ) Notice: Subject to any disclaimer, the term of this patent is extended or adjusted under 35 U.S.C. 154(b) by 359 days.

(21) Appl. No.: 15/606,310

(22) Filed: May 26, 2017

(65) Prior Publication Data

US 2017/0266686 A1 Sep. 21, 2017

Related U.S. Application Data

(60) Continuation of application No. 14/975,741, filed on Dec. 19, 2015, now Pat. No. 9,744,550, which is a division of application No. 13/602,052, filed on Aug. 31, 2012, now Pat. No. 9,221,070.

(60) Provisional application No. 61/573,234, filed on Aug. 31, 2011.

(51) Int. Cl.

| | |
|---|---|
| ***B05B 17/00*** | (2006.01) |
| ***B05B 17/08*** | (2006.01) |
| *F21S 13/00* | (2006.01) |
| *F21W 121/02* | (2006.01) |

(52) U.S. Cl.

CPC ..... *B05B 17/085* (2013.01); *B05B 17/08* (2013.01); *F21S 13/00* (2013.01); *F21W 2121/02* (2013.01)

(58) Field of Classification Search

CPC ..... B05B 17/085; B05B 17/08; F21S 13/00; F21W 2121/02

USPC ..... 239/12, 17, 18, 20, 23

See application file for complete search history.

(56) References Cited

U.S. PATENT DOCUMENTS

| | | | | |
|---|---|---|---|---|
| 2,888,205 | A * | 5/1959 | Giovanni Trucco | F21S 8/00 239/20 |
| 5,167,368 | A * | 12/1992 | Nash | B05B 17/085 239/17 |
| 6,149,070 | A * | 11/2000 | Hones | B05B 1/044 239/16 |
| 2010/0170960 | A1* | 7/2010 | Barnhill | A47G 7/08 239/17 |

* cited by examiner

*Primary Examiner* — Qingzhang Zhou

(74) *Attorney, Agent, or Firm* — The Noblitt Group, PLLC

(57) ABSTRACT

Systems and apparatus for a water fountain that converts turbulent flow of a fluid to laminar flow. The water fountain may include a basin, a fluid distribution port, at least one water support, a fluid distribution media, and an annular scupper. The fluid distribution port may be located within the basin above the bottom and between the circular inner wall and the outer wall. The at least one water supply port may extend through the bottom and coupled to the fluid distribution port. The fluid distribution media may be located within the basin, between the circular inner wall and the outer wall, and above the fluid distribution port. The annular scupper may be located on top of the inner wall and capable of applying a surface tension to a fluid to thin the fluid into a continuous laminar sheet downward in a circular cascade sheet into a cascade chamber.

22 Claims, 9 Drawing Sheets

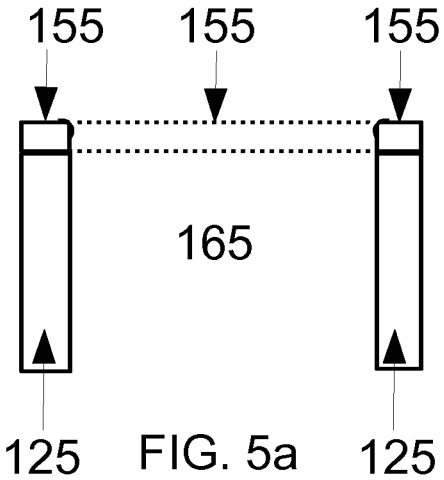
FIG. 5a
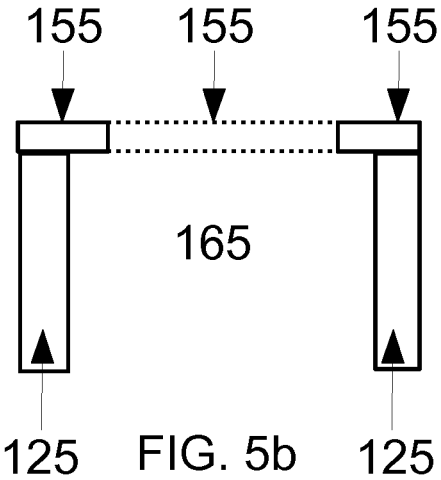
FIG. 5b
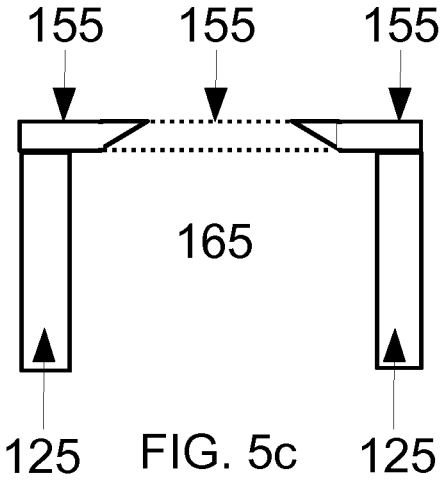
FIG. 5c
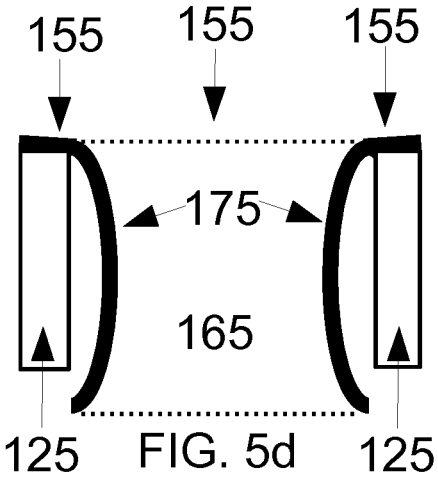
FIG. 5d
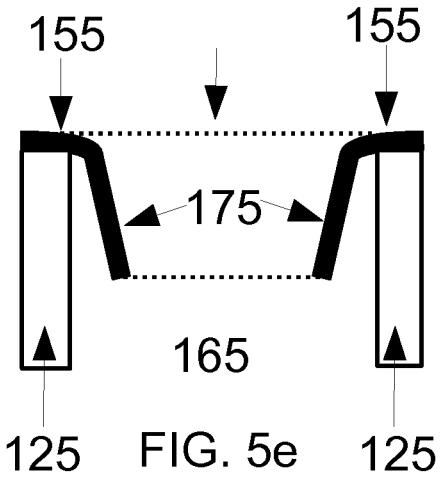
FIG. 5e
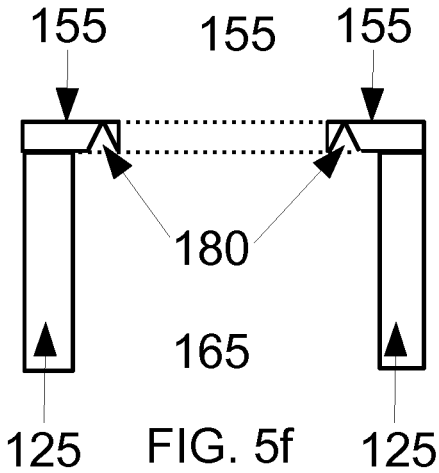
FIG. 5f
FIG. 5

WATER FOUNTAIN

CROSS-REFERENCES TO RELATED APPLICATIONS

This application is a continuation of U.S. patent application Ser. No. 14/975,741, filed Dec. 19, 2015, which is a divisional application of U.S. patent application Ser. No. 13/602,052, filed Aug. 31, 2012, now U.S. Pat. No. 9,221,070, which application claims the benefit of U.S. Provisional Patent Application 61/573,234 filed Aug. 31, 2011 and titled "FIRE AND WATER FOUNTAIN," the disclosures of which is incorporated by reference. To the extent that the present disclosure conflicts with any referenced application, however, the present disclosure is to be given priority.

BACKGROUND OF THE INVENTION

Water fountains throughout history and worldwide have captured people's attention. Water fountains generally have a basin for capturing falling water and a pump to raise the water to a stand above the basin. The water is then sprayed or flows from the stand to an outer edge, and cascades down to the basin.

For nighttime display, some fountains have electrically secure lights within the basin, within the stand, or sometimes safely outside the water, to add sparkle or color to the fountain. Other fountains have fire displays walled away from the water or above the water to enhance the enjoyment of nighttime water displays.

SUMMARY OF THE INVENTION

Systems and apparatus for a water fountain that converts turbulent flow of a fluid to laminar flow. The water fountain may include a basin, a fluid distribution port, at least one water support, a fluid distribution media, and an annular scupper. The basin may include a circular inner wall having an upper edge and a lower edge, an outer wall having an upper edge and a lower edge, and a bottom connecting the lower edge of the circular inner wall to the lower edge of the of the outer wall. The fluid distribution port may be located within the basin above the bottom and between the circular inner wall and the outer wall. The at least one water supply port may extend through the bottom and coupled to the fluid distribution port. The fluid distribution media may be located within the basin, between the circular inner wall and the outer wall, and above the fluid distribution port. The annular scupper may be located on top of the inner wall and capable of applying a surface tension to a fluid to thin the fluid into a continuous laminar sheet downward in a circular cascade sheet into a cascade chamber.

The water fountain may display fire inside a falling water cascade. The water fountain may receive fluid into an upper basin. The upper basin has an outer wall and a circular inner wall. The circular inner wall is lower in height than the outer wall.

The fluid distribution media removes turbulent flow so that the fluid rises laminar and clear without turbulent currents or eddies at the surface. As the fluid flows gently above the circular inner wall, the fluid flows inwardly onto the continuous scupper with a hollow center. Surface tension and gravity thin the fluid film so that the fluid film flows smoothly over the continuous scupper. The fluid film reaches the inner edge of the continuous scupper. Surface tension, viscosity and gravity pull the fluid into a circular cascade sheet with laminar streamlines that fall away from the upper basin.

Beneath the upper basin within the circular cascade sheet is a fire, such as a lit candle or gas lamp. The fire shimmers through the laminar streamlines of the circular cascade sheet. A lower basin collects the fluid. A pump and delivery tube returns the fluid to the upper basin.

Also disclosed are various embodiments of the fluid distribution system. The fluid distribution system may comprise a fluid distribution ring in the upper basin with a slot or a plurality of holes. The slot or holes may be sized relative to a flow characteristic. The slot or holes may be sized so that equal flow comes from each hole. The fluid distribution system may include a sieve or solids in the upper basin to break-up flow patterns in the water. These solids may be sized relative to the flow characteristic.

Other embodiments may include a prescupper to provide additional smoothing effects of the fluid to the continuous scupper. Other embodiments include variations of the continuous scupper to affect the flow characteristic into the circular cascade sheet.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

FIGS. 5A, 5B, 5C, 5D, 5E and 5F show alternative embodiments of continuous scuppers of a water fountain;

DETAILED DESCRIPTION OF EXEMPLARY EMBODIMENTS

The present technology may be described in terms of functional block components and various processing steps. Such functional blocks may be realized by any number of components configured to perform the specified functions and achieve the various results. For example, the present technology may employ various process steps, apparatus, systems, methods, etc. In addition, the present technology may be practiced in conjunction with any number of systems and methods for a water fountain that converts turbulent flow of a fluid to laminar flow, and the system described is merely one exemplary application for the technology. Further, the present technology may employ any number of conventional techniques for filtering materials contained within a container.

The particular implementations shown and described are illustrative of the technology and its best mode and are not intended to otherwise limit the scope of the present technology in any way. For the sake of brevity, conventional manufacturing, connection, preparation, and other functional aspects of the system may not be described in detail. Furthermore, the connecting lines shown in the various figures are intended to represent exemplary functional relationships and/or steps between the various elements. Many alternative or additional functional relationships or physical connections may be present in a practical system.

Figure 1:
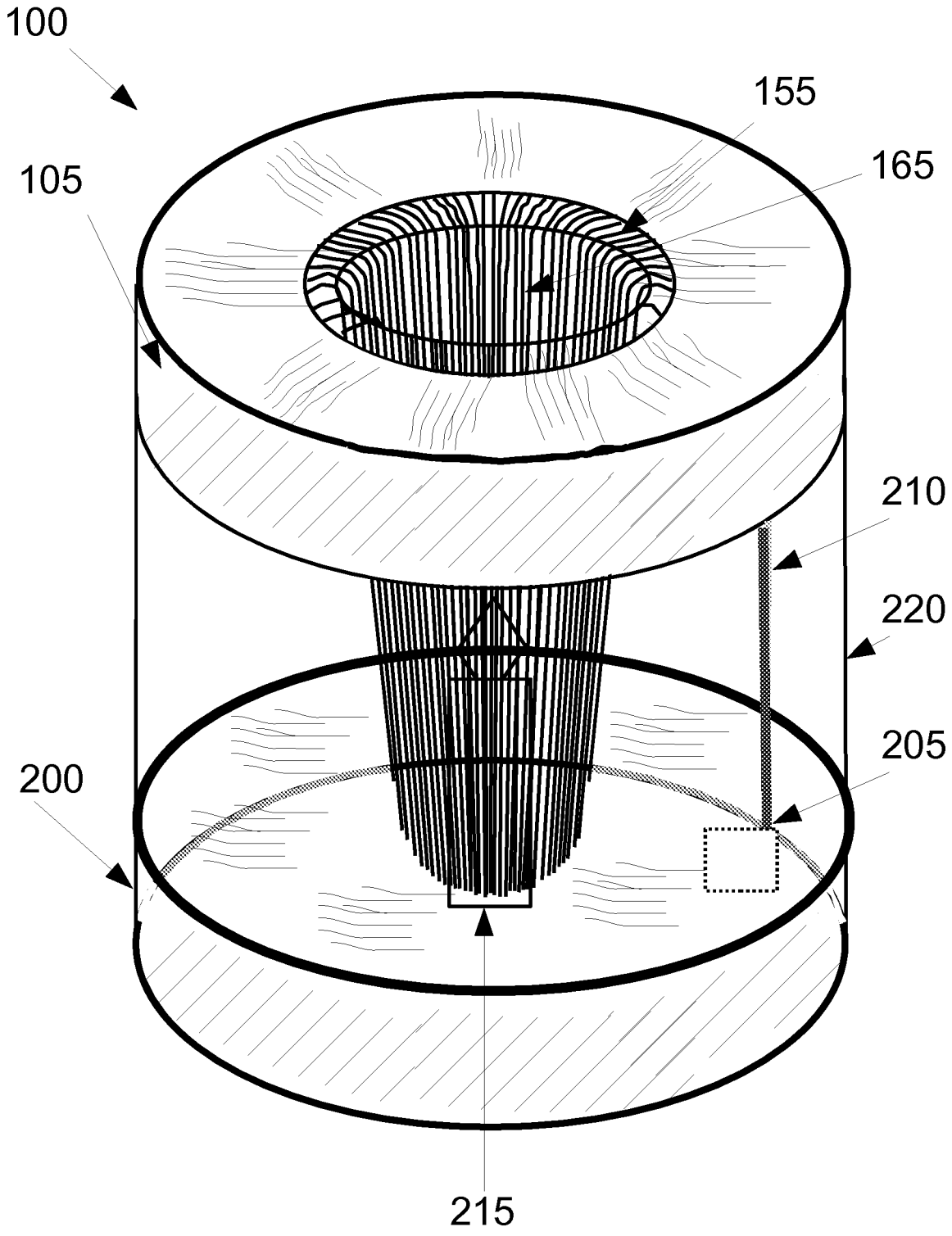
FIG. 1 shows a view of an exemplary embodiment of a water fountain in operation.

Systems and apparatus for a water fountain (100) that converts turbulent flow of a fluid to laminar flow are shown in FIG. 1. FIG. 1 shows portions of the components of the water fountain (100) during operation. Shown in FIG. 1 are an exemplary upper basin (105), an exemplary continuous scupper (155), a cascade chamber (165), lower basin (200), a pump (205), a delivery tube (210), a fire fixture (215), and stanchions (220).

The water fountain (100) receives a fluid into the upper basin (105). The upper basin (105) is a containment vessel for the fluid. In one embodiment, the fluid is water.

Components within the upper basin (105), shown in other drawings, distribute the fluid throughout the upper basin (105). As the fluid fills the upper basin (105), it reaches the level of the continuous scupper (155). The height of the continuous scupper (155) is less than the height of the outer wall (shown in other drawings) of the upper basin (105). The fluid flows over the continuous scupper (155), and into the cascade chamber (165). Various embodiments of the continuous scupper (155) direct the fluid into patterns as gravity pulls the fluid downward in a circular cascade sheet.

Centrally nested beneath the upper basin (105) within the circular cascade sheet is a fire, such as a lit candle or gas lamp (215). The fire shimmers through the laminar streamlines of the circular cascade sheet.

The lower basin (200) collects the fluid. The pump (205) and delivery tube (210) return the fluid the upper basin (105). Stanchions (220) may be used to hold the upper basin (105) in place. In some embodiments, one or more delivery tubes (210) are used to hold the upper basin (105) in place.

Figure 2:
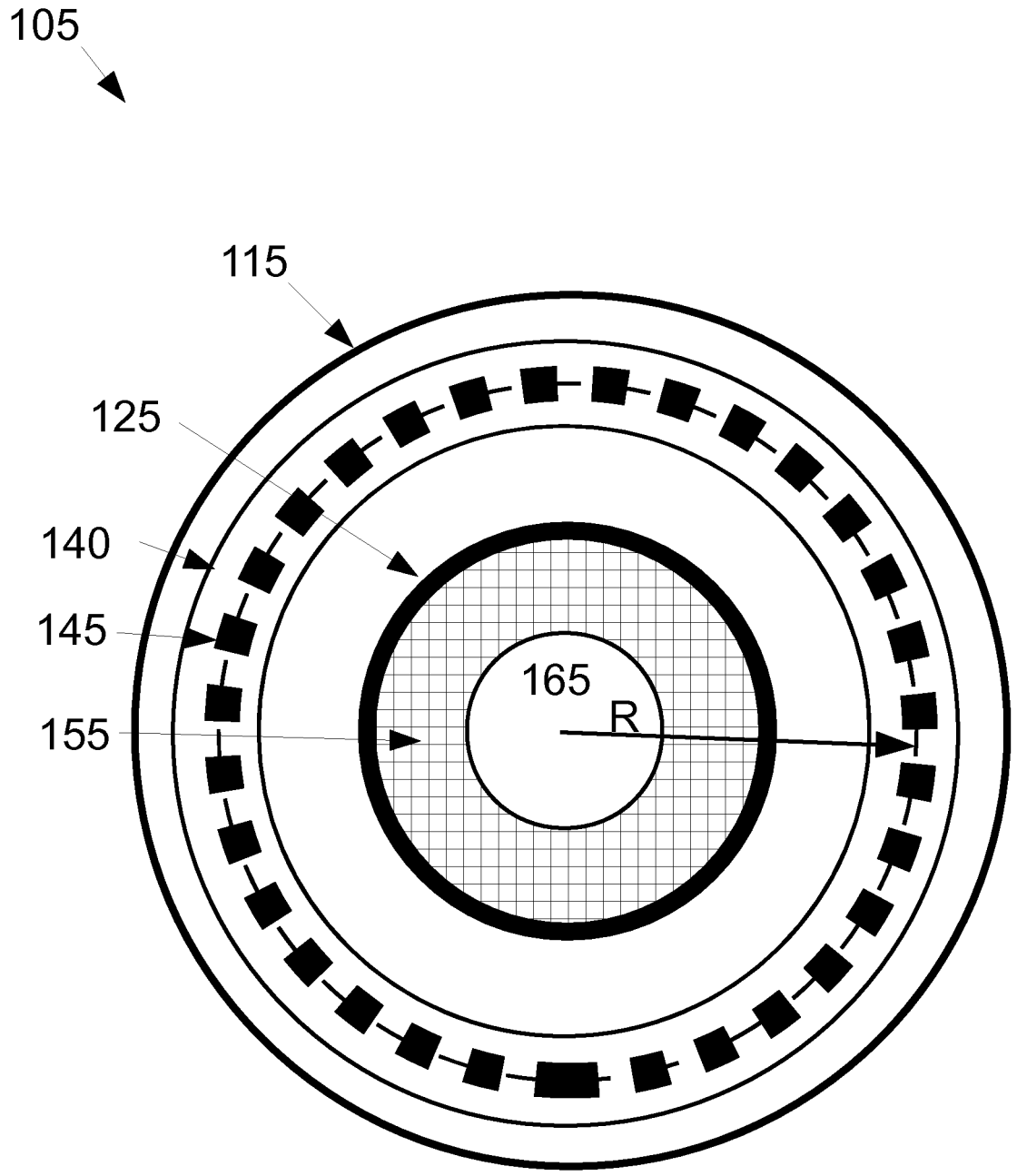
FIG. 2 shows a top view of an exemplary upper basin of an embodiment of the water fountain.

FIG. 2 shows a top view of the upper basin (105) of an embodiment of the water fountain (100). The upper basin (105) as shown in FIG. 2 may comprise an upper basin outer wall (115) and an upper basin inner wall (125). In various embodiments that upper basin may comprise a fluid distribution ring (140), a fluid distribution port (145), a continuous scupper (155), and the cascade chamber (165).

The upper basin outer wall (115) provides an outer containment for the fluid within the upper basin (105). In an exemplary embodiment, the upper basin outer wall (115) is circular, although the configuration (round, square, rectangular, etc.) of the upper basin outer wall (115) is not as significant to the effective operation of the water fountain (100).

Also within the upper basin (105) is the upper basin inner wall (125). The upper basin (105) and the upper basin inner wall (125) (together with the upper basin bottom (110)), shown in FIG. 3) provide containment for the fluid flowing through the water fountain (100).

In an exemplary embodiment, the upper basin inner wall (125) may be circular. A circular configuration of the upper basin inner wall (125) affects the flow characteristics of the fluid in the upper basin (105) and the circular cascade sheet.

The upper basin (105) receives fluid from the pump (205) and delivery tube (210) through a fluid supply port (130, shown in FIG. 3) into the fluid distribution ring (140). As shown in FIG. 2, the distribution ring (140) lies within the upper basin (105) between the upper basin outer wall (115), and the upper basin inner wall (125). Though shown as completely circular (i.e., 360-degrees within the upper basin (105)) the fluid distribution ring (140) may be less than completely circular. In an exemplary embodiment, the fluid distribution ring (140) is nearly completely circular, i.e., in the range of 345 degrees to 360 degrees. As described below, the fluid distribution ring (140) provides better flow characteristics than a fluid distribution ring (140) that is not nearly completely circular.

Within the fluid distribution ring (140) is the fluid distribution port (145). The fluid distribution port (145) is an exit port into the upper basin (105) for fluid entering the fluid distribution ring (140). As with the fluid distribution ring (140), the fluid distribution port (145) may be substantially completely circular in an exemplary embodiment, and for the same reason.

FIG. 2 also shows an exemplary continuous scupper (155) and an exemplary cascade chamber (165). An outer edge of the continuous scupper (155) may be located on top of the upper basin inner wall (125). R is the Radius of the continuous scupper inner edge. There are several embodiments of the continuous scupper (155), which are discussed in greater detail in FIG. 5. As discussed above and below, the fluid in the upper basin (105) flows over the continuous scupper (155). When the fluid reaches the inner edge of the continuous scupper (155), which in this embodiment is above the cascade chamber (165), the fluid flows downwards (as shown in FIG. 1), into the cascade chamber (165).

Figure 3:
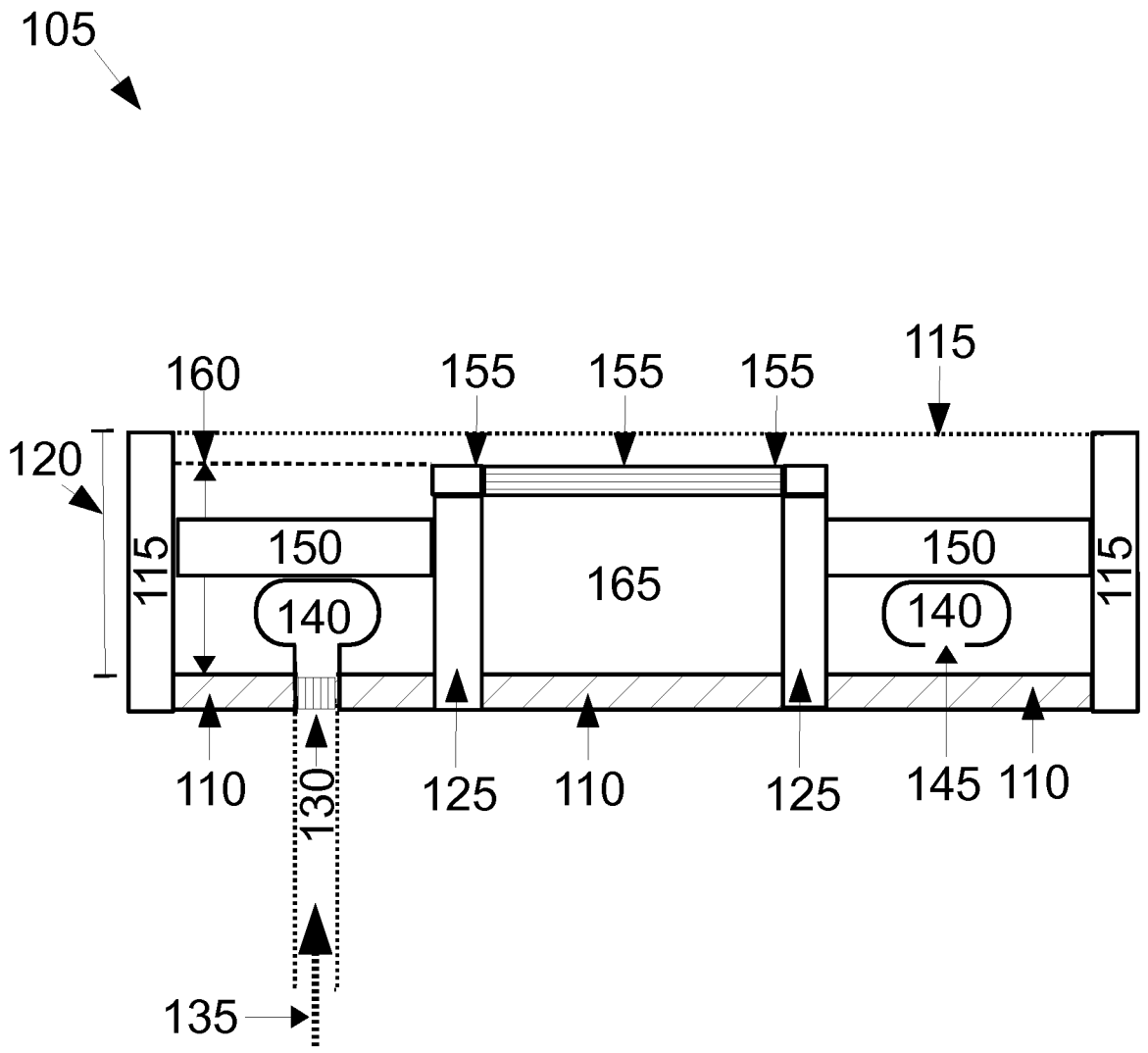
FIG. 3 shows a cut-away side view of an exemplary upper basin of an embodiment of a water fountain.
Figure 4:
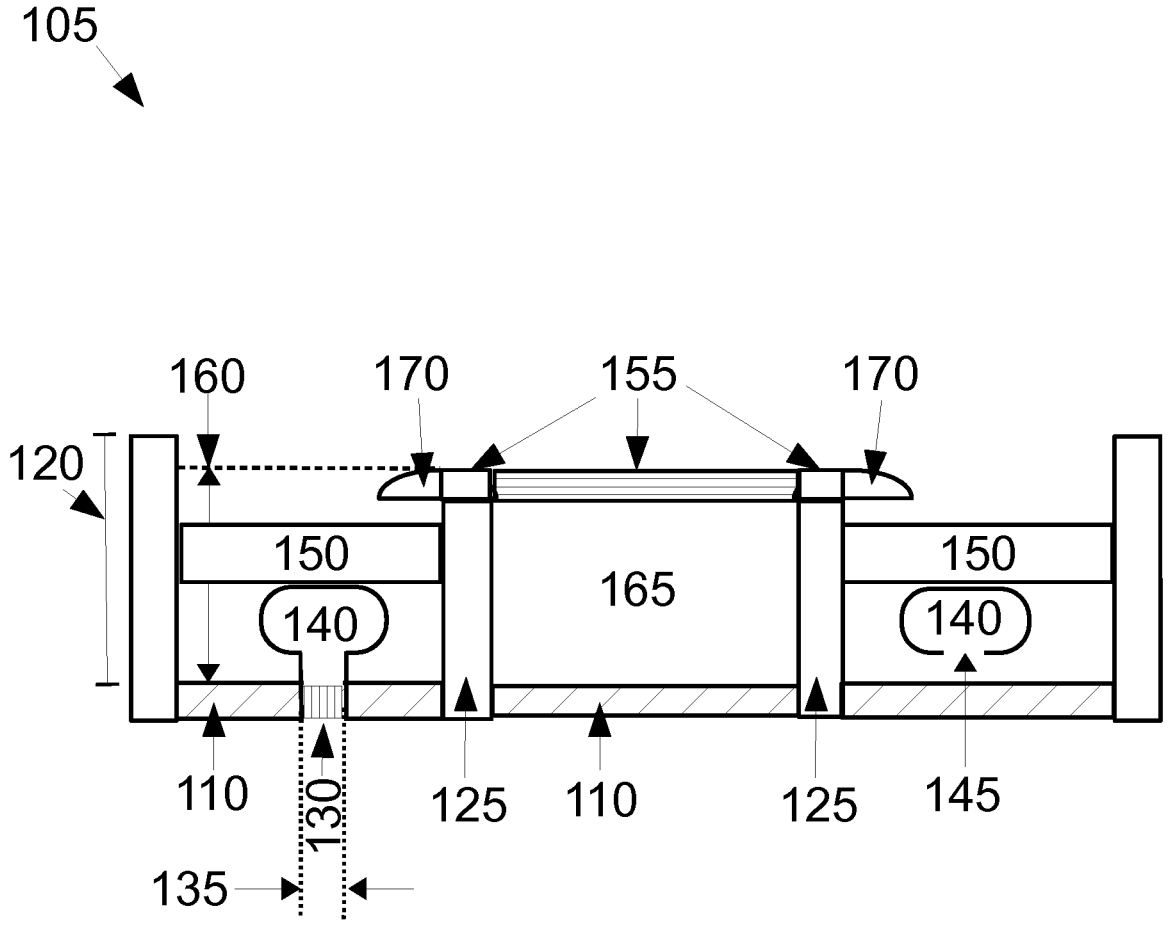
FIG. 4 shows a cut-away side view of an alternative embodiment of an upper basin of a water fountain.

Surrounding the cascade chamber (165) is the upper basin inner wall (125). As with the upper basin inner wall (125), a circular cascade chamber (165) is shown in an exemplary embodiment. FIGS. 3 and 4 show the cascade chamber (165) in greater detail.

FIG. 3 shows a cut-away side view of an exemplary upper basin (105) of an embodiment of a water fountain (100). Among the components shown in FIG. 3 are a upper basin bottom (105), an upper basin outer wall (115), an upper basin outer wall height (120), an upper basin inner wall (125), a fluid supply port (130), a flow characteristic (135), a fluid distribution ring (140), a fluid distribution port (145), a fluid distribution media (150), a continuous scupper (155), a combined height (160), and a cascade chamber (165).

The upper basin bottom (110) serves as a lower containment barrier to the fluid in the upper basin (105). The upper basin bottom (110) may be manufactured of any non-permeable material. Metals such as copper, brass, or steel, may be used as they are relatively easy to work with and lightweight. The upper basin bottom (110) may be made of concrete, or other building materials, with appropriate concerns for their permeability, durability or weight.

The upper basin bottom (110) also serves as part of the support structure of the upper basin (105). In some embodiments, stanchions support the upper basin (105). These stanchions may be connected between the lower basin (200) and the upper basin (105) at the upper basin bottom (110), or the upper basin outer wall (120). In some embodiments, one or more fluid delivery tubes (210) serves as a stanchion through its connection to the upper basin bottom (110).

The general configuration of the upper basin bottom (110) is of a flat plate with an outer edge to align with the upper basin outer wall (115) and a hollow center to align with the upper basin inner wall (125) and the cascade chamber (165).

In some embodiments, the upper basin bottom (110) is round. In some embodiments, the upper basin bottom (110) is square. In some embodiments, the upper basin bottom (110) is rectangular. It should be appreciated that any suitable shape of the upper basin bottom (110) may be contemplated.

The upper basin bottom (110) also has a fluid supply port (130) penetrating it and extending therethrough for the fluid delivery tube (210).

The upper basin outer wall (115) serves as the outer containment barrier to the fluid in the upper basin (105). The dotted line marked (115) in FIG. 3 is to show that the upper basin outer wall (115) circumferentially defines the upper basin (105), at the height of the dotted line.

The upper basin outer wall (115) may be manufactured of any non-permeable material. Metals such as copper, brass, or steel, may be used as they are relatively easy to work with and lightweight. The upper basin outer wall (115) may be made of concrete, or other building materials, with appropriate concerns for their use. In some embodiments, the upper basin outer wall (115) may be made of another material for aesthetic or structural considerations.

The outer configuration of the upper basin outer wall (115) may be the same configuration as the upper basin bottom (110). If the upper basin bottom (110) is round, the upper basin outer wall (115) is round. If the upper basin bottom (110) is square, the upper basin outer wall (115) is typically square. If the upper basin bottom (110) is typically rectangular, the upper basin outer wall (115) is typically rectangular. The configurations may be different (one round, one oval, etc.), when aesthetic or structural concerns dictate a different configuration.

The upper basin inner wall (125) may be attached to the upper basin bottom (110). The upper basin inner wall (125) serves as the inner containment barrier to the fluid in the upper basin (105).

The upper basin inner wall (125) may be manufactured of any non-permeable material. Metals such as copper, brass, or steel, may be used as they are relatively easy to work with and lightweight. The upper basin inner wall (125) may be made of concrete, or other building materials, with appropriate concerns for their use. In some embodiments, the upper basin inner wall (125) may be made of another material for aesthetic or structural considerations.

In various embodiments, the upper basin inner wall (125) is substantially cylindrical. The upper basin inner wall (125) may serve as a support structure for the continuous scupper (155), the border for the cascade chamber (165), and/or the prescupper (170) (discussed in FIG. 4).

Like other fountains, the water fountain (100) may be constructed in several size versions. The water fountain (100), however, differs significantly from other fountains in that the water fountain (100) is an inwardly flowing fountain. To achieve this inward flow, the upper basin outer wall height (120) must be higher than the exit of the fluid, which occurs at the upper basin inner wall (125).

The fluid supply port (130) is the entry port for fluid from the lower basin (200) to the upper basin (105). In an exemplary embodiment, the fluid supply port (130) may be one hole through the upper basin bottom (110) and connected to the fluid delivery tube (210). In some embodiments, the fluid supply port (130) may be two or more holes through the upper basin bottom (110) and connected to one or more fluid delivery tubes (210).

An important aspect of the water fountain (100) is matching the fluid flow rate and flow characteristic through the fluid delivery port (130) to the desired flow characteristics through the cascade chamber (165) of the water fountain (100). One of the factors for consideration is the size of the fluid supply port (130).

To achieve proper flow characteristics, the fluid supply port (130) should be of a size proportional to the flow characteristic (135). The flow characteristic (135) is similar to a vector, i.e., it is not a specific dimension, but represents a proportionality to the fluid flow rate through each portion of the water fountain (100), as will be discussed further. Another use of the flow characteristic would be for determining the proper distance between the fluid distribution ring (140) and the upper basin bottom (110).

Also shown in FIG. 3 is the fluid distribution ring (140). The fluid distribution ring (140) receives fluid from the fluid supply port (130) and distributes the fluid to the fluid distribution port (145). The fluid distribution ring (140) may be manufactured of any non-permeable material. Metals such as copper, brass, or steel, may be used as they are relatively easy to work with and lightweight. As with the fluid supply port (130), the size (as proportional to the flow rate) of the fluid distribution ring (140) should be identical or close to the flow characteristic (135). Matching the size (e.g., cross-sectional area) of the fluid distribution ring (140) to the fluid delivery port (130) is important so that the flow rate is balanced to achieve a laminar fluid flow into the cascade chamber (165). If the flow rate is too low, the fluid entering the cascade chamber will break apart in a dribble pattern. If the flow rate is too high, the fluid flow over the continuous scupper (155) will not be laminar.

Also shown in FIG. 3 is the fluid distribution port (145). The fluid distribution port (145) receives fluid from the fluid distribution ring (140) and distributes the fluid around the upper basin (105). In an exemplary embodiment, the fluid distribution ring (145) is a slot or a plurality of slots. In some embodiments, the fluid distribution port (145) is a plurality of holes. As with the fluid supply port (130) and the fluid distribution ring (140), the size of the fluid distribution port (145) (as proportional to the flow rate) should be proportional to the flow characteristic (135).

In an embodiment using holes, the fluid distribution ring port holes (145) are of equal size and equal spacing and the fluid distribution ring port (140) is mounted above the upper basin bottom (110) no closer than the diameter of the fluid distribution ring holes (145). For example, for a 1.5-inch diameter fluid distribution ring (140), with five holes for the fluid distribution ring port (145), equal flow rate occurred if each hole was 0.85 inches in diameter. Above that size, uneven flow occurred.

Also shown in FIG. 3 is the fluid distribution media (150). The fluid distribution media (150) provides a slight backpressure and flow dispersion to the fluid so that turbulent currents from the fluid distribution port (145) are converted to near laminar fluid flows.

The fluid distribution media (150) may be metal, paper, or other material. Unlike the upper basin outer wall (115), upper basin inner wall (125), or fluid distribution ring (140), the fluid distribution media (150) may be made of non-permeable material with permeable portions or permeable material. The fluid distribution media (150) must, however, be made of a durable material to withstand the fluid currents, unless the fluid distribution media (150) is intended for temporary use.

In some embodiments, the fluid distribution media (150) is one or more fine sieves. In some embodiments, the fluid distribution media (150) may be one or more different mesh sieves. A coarse fluid distribution media (150) may be near the fluid distribution ring (140) with a finer fluid distribution media (150) on the other side of the coarse fluid distribution media (150). The coarse fluid distribution media (150) may include commercial materials such as woven plastic pads or other commercial materials that would disperse fluid flow around the upper basin (105) and contribute to laminar flow.

The fluid distribution media (150) may also be a plurality of round or semi-round natural objects, such as stones, rocks, or sand with fine distribution media on top of coarse distribution media. Marbles may also be used.

Also shown in FIG. 3 is the continuous scupper (155). The continuous scupper (155) is a key component of the water foundation (100). In general, a scupper is a defined path that discharges a fluid, such as rain from a pathway, building or a vessel. Most often a scupper is flat and three-sided and the rain falls wherever the flow-rate, gravity and the height of the scupper take the rain. Some scuppers may be used with troughs to direct the rain away from people and from areas that cannot withstand the erosion of falling or running water.

The continuous scupper (155) of the water fountain (100) provides an exit path of the fluid from the upper basin (105). In an exemplary embodiment, the continuous scupper (155) has a circular outer edge with a hollow center so that the fluid flows inward toward a central point, i.e., the cascade chamber (165), and the continuous scupper (155) applies a surface tension (i.e., drag) affect to the fluid to thin the fluid into a continuous laminar sheet that falls through the cascade chamber (165) with a specifically designed 3-dimensional shape. One of these 3-dimensional designs is represented in FIG. 1.

The continuous scupper (155) sits on top of the upper basin inner wall (125). In some embodiments, the continuous scupper (155) extends over the cascade chamber (165). In other embodiments, the continuous scupper (155) extends into the cascade chamber (165). Various designs for the continuous scupper (155) are shown in FIG. 5. The continuous scupper (155) may be made from any material. Metals such as copper, brass, or steel, may be used as they are relatively easy to work with and lightweight. Other materials may be used as with appropriate concerns for their permeability, durability or weight and aesthetic or structural considerations.

Also shown in FIG. 3 is the combined height (160). The combined height (160) is another key component of the water fountain (100). As shown by FIG. 3, the combined height (160) is the sum of the height of the upper basin inner wall (125) above the upper basin bottom (110) and the height of the continuous scupper (155). As also shown by FIG. 3, the combined height (160) is less than the height (120) of the upper basin outer wall (115) above the upper basin bottom (110). This height difference directs the flowing fluid to flow over the continuous scupper (155) and then into the cascade chamber (165), rather than over the upper basin outer wall (115). In this way, the design of the continuous scupper (155) has an effect on the flow path of the falling fluid.

Also shown in FIG. 3 is the cascade chamber (165), which is a pathway formed by the upper basin inner wall (125) into which the fluid falls from the continuous scupper (155). The cascade chamber (165) has a diameter equal to the diameter formed by the upper basin inner wall (125), and a depth equal to the combined height (160) plus the thickness of the upper basin bottom (110). Though the size of the cascade chamber (165) is not as critical as those of the upper basin outer wall (115) and the combined height (160), the cascade chamber (165) must be sufficiently large so that the fluid flowing onto and falling off the continuous scupper (155) does not cross the mid-line (not shown) of the cascade chamber (165) and intersect, thus causing a splashing effect.

FIG. 4 shows a cut-away side view of an alternative embodiment of a water fountain. FIG. 4 is substantially the same as FIG. 3, with two exceptions. These are that the line representing the combined height (120) of the upper basin outer wall (115) is removed for clarity, and FIG. 4 shows a prescupper (170).

As shown in FIG. 4, the prescupper (170) serves as an extension surface to the fluid before the fluid reaches the continuous scupper (155). The prescupper (170) provides additional surface area on which to increase drag on the fluid, thus thinning the fluid thickness before the fluid reaches the continuous scupper (155).

This prescupper (170) extension surface is beneficial in water fountains (100) where the continuous scupper (155) surface area is insufficient to thin the fluid to a laminar condition before the fluid falls off the continuous scupper (155). These circumstances may exist with smaller water fountains since surface area is proportional to the square of the radius, and with higher flow rates where drag is similarly an exponential function. These circumstances may also exist with a continuous scupper (155) that by shape or by vertical angle is insufficient to thin the fluid to a laminar condition before the fluid falls off the continuous scupper (155), as shown in FIG. 5.

FIGS. 5A, 5B, 5C, 5D, 5E and 5F show additional embodiments of continuous scuppers (155) of a water fountain (100).

FIG. 5A shows an embodiment of a continuous scupper (155) in which the fluid flows over and off the continuous scupper (155) with next to no horizontal velocity and thus flows down the walls of the cascade chamber. In an exemplary embodiment, the upper corner of the inner edge of the continuous scupper (155) is rounded.

FIG. 5B shows an embodiment of a continuous scupper (155) in which the fluid flows over and off the continuous scupper (155) with minimal horizontal velocity.

FIG. 5C shows an embodiment of a continuous scupper (155) in which the fluid flows over and off the continuous scupper (155) with moderate horizontal velocity. The angular tip of the continuous scupper (155) greatly reduces fluid dripping.

FIG. 5D shows an embodiment of a continuous scupper (155) known as a contour continuous scupper (175). With this embodiment, the continuous scupper outer edge is higher than the continuous scupper lower edge. The fluid flows over and then down the continuous scupper (155) and is then imparted with angular momentum by slope of the contour continuous scupper (175). With the proper flow rate, this embodiment of the continuous scupper (155) produces a circular cascade sheet that resembles a champagne flute. In some embodiments, as shown in FIG. 5D, the continuous scupper (155) extends below the upper basin bottom (110). (This is the Vesuvius model).

FIG. 5E shows an embodiment of a contour continuous scupper (175). The fluid flows over and then down the continuous scupper (15), then flows with some inward angular momentum. With the proper flow rate, this embodiment of the contour continuous scupper (175) produces a rifled (i.e., twisted) circular cascade sheet. The vertical and horizontal angles can be adjusted to launch the fluid further inwards.

FIG. 5F shows an embodiment of a continuous scupper (155) with a notched tip (180). A notched tip (180) is beneficial during low flow conditions of startup and shutdown of the water fountain (100) to prevent dripping. The notched tip (180) may be used with most continuous scuppers (155).

Figure 6:
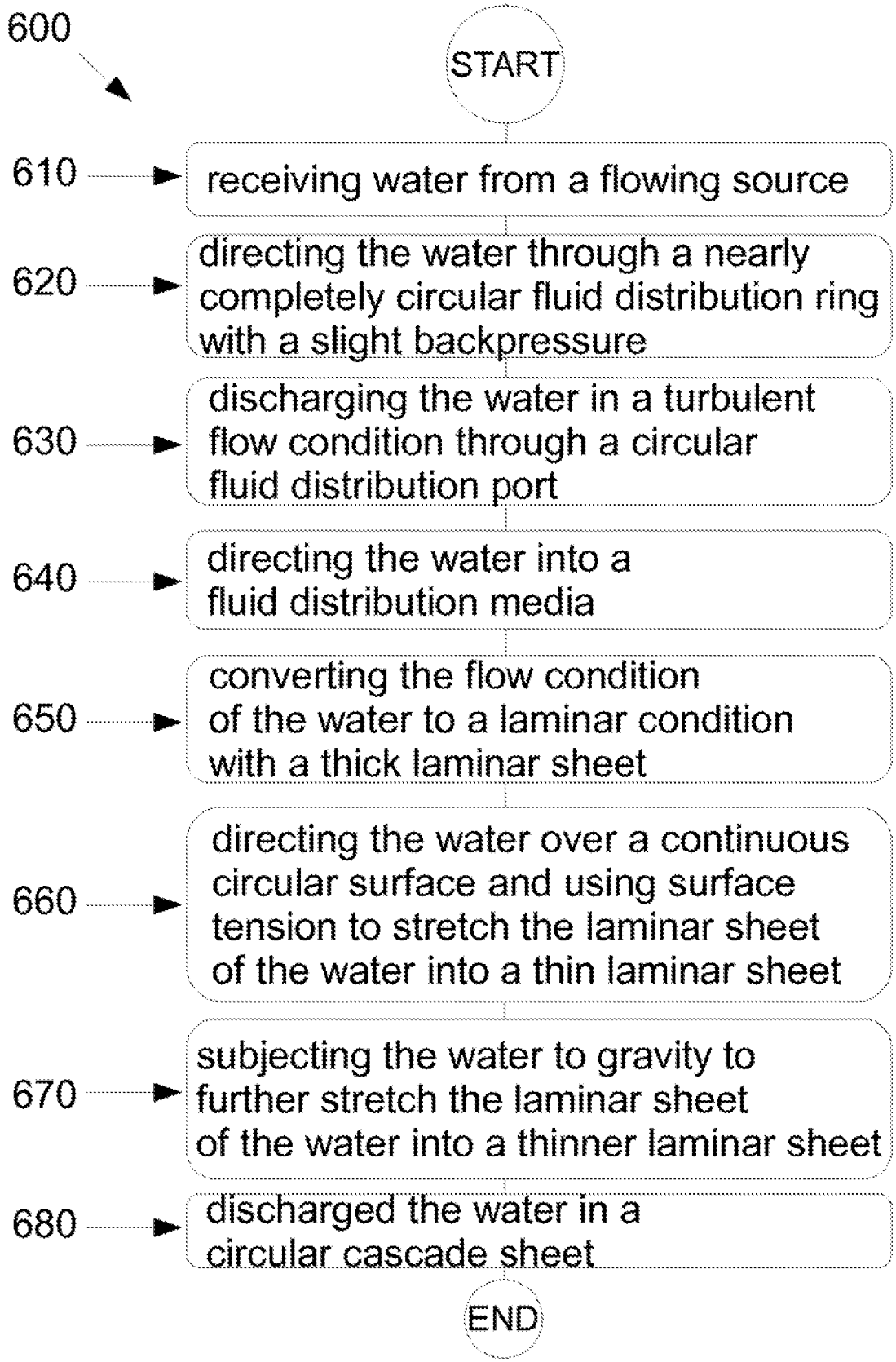
FIG. 6 shows a method for directing falling water into a circular cascade sheet.

FIG. 6 shows a method for directing falling water into a circular cascade sheet.

At step 610, water is received from a flowing source

At step 620, the water is directed through a nearly completely circular fluid distribution ring with a slight backpressure.

At step 630, the water is discharged in a turbulent flow condition through a circular fluid distribution port At step 640, the water is directed into a fluid distribution media.

At step 650, the flow condition of the water is converted to a laminar condition with a thick laminar sheet.

At step 660, the water is directed over a continuous circular surface and using surface tension to stretch the laminar sheet of the water into a thin laminar sheet.

At step 670, the water is subjected to gravity to further stretch the laminar sheet of the water into a thinner laminar sheet.

At step 680, the water is discharged in a circular cascade sheet.

Engineering of the water fountain (100) includes multiple principles of physics.

Among these principles is that flow rate (Q) is proportional to the fluid velocity (V) and the cross-sectional area (A) of the fluid flow container, i.e., Q=V*A. In the water fountain (100) the flow rate Q1 from the pump is equal to Q2 through the fluid delivery tube (210) to the upper basin (105), i.e., Q1=Q2.

Similarly, the flow rate Q2 from the fluid delivery tube (210) must be equal to the flow rate Q3 into the fluid distribution ring (140) and through the fluid distribution port (145) into the upper basin (105), i.e., Q2=Q3.

Likewise, the flow rate Q3 from the fluid distribution port (145) must be equal to the flow rate Q4 over the continuous scupper (155) and the flow rate Q5 through the cascade chamber (165), i.e., Q3=Q4=Q5.

Consequently, Q1=Q2=Q3=Q4=Q5.

The basic formula for flow rate though a circular tube is the fluid velocity times the cross-sectional area of the tube, i.e., Q=V*A where the Area=pi(Π) times the square of the radius (Rt) of the circular tube, A=Π*Rt^2.

If the cross-sectional areas of the pump discharge (205), the fluid delivery tube (210), the fluid distribution ring (140) and the fluid distribution port (145) are kept the same, then the flow rates will be equal.

Similarly, if a slot is used in the fluid distribution port (145), then the area of the slot would be equal to the cross-sectional area of the fluid delivery tube (210) to maintain the same velocity. In an exemplary embodiment, however, the cross-sectional area of the fluid distribution port (145) is larger than the cross-sectional area of the fluid delivery tube (210). The increase in cross-sectional area decreases the velocity of the fluid flowing into the upper basin (105).

If holes are used in the fluid distribution port (145), then a slight backpressure is used within the fluid distribution ring (140) to create equal flow rate from each hole. In this instance, there is also an equation describing the radius of each fluid distribution port (145). This equation is r=(Q/(n*Π*V))^½, in which Q is the flow rate into the fluid distribution ring (140), n is the number of holes and V is the flow velocity through the fluid distribution ports (145).

The basic formula for flow rate over a flat surface is velocity times the thickness (T) of the fluid sheet times the width (W) of the fluid sheet, i.e., Q=V*A=V*T*W.

In an incompressible flowing fluid, the values are co-dependent, i.e., the thickness (T) of the fluid sheet is proportional to the fluid velocity, the width (W) of the available flow area, and the density and viscosity of the fluid. In addition, the width (W) of the available flow area over the continuous scupper (155) is dependent on the radius (Rs) of the continuous scupper (155) at the point of exit, W=2*Π*Rs. At this point, Q4=V*T*2*Π*Rs.

In instances where the fluid distribution ports (145) are holes, another equation describes the continuous scupper inner edge radius. This equation is R=(n*A*V2)/(2*Π*T*V3), where R is the Radius of the continuous scupper inner edge, n is the number of hole in the fluid distribution ring (140), A is the Area of each fluid distribution port hole (145), V2 is the flow velocity from each fluid distribution port hole (145), T is the thickness of the fluid flowing over the continuous scupper (155), and V3 is the flow velocity over the continuous scupper (155). If the fluid distribution port (145) is not a plurality of holes then, n=1.

In addition, the flow rate Q4 of the fluid into the circular cascade sheet must be large enough to maintain continuity (i.e., the appearance) of the circular cascade sheet, i.e., without breaking apart, keeping in mind that gravity (g=32.2 ft/sec/sec) will accelerate the falling fluid. Hence, the flow rate Q4=Q5=V*A=V*T*2*Π*Rc, where Rc is the radius of the circular cascade sheet. Depending on which continuous scupper (155, 175, etc.) is used, the Rc is the radius of the circular cascade sheet is equal to than the radius (Rs) of the continuous scupper (155) at the point of exit As Q4=Q5 where Q4=V*T*2*Π*Rs, and Q5=V*A=V*T*2*Π*Rc, then the relative variables are V*T*Rs=V*T*Rc. Consequently, as the velocity of the falling fluid increases, the circular cascade sheet thickness decreases.

To maintain laminar flow with a relatively clear circular cascade sheet, the Reynolds number of a flowing fluid should be less than 2000. The formula for a Reynolds number (Rn) of a flowing fluid in a pipe is Rn=(V*D*p)/n, where V is the velocity of the flow, D is the diameter of a pipe, p is the density of fluid, and n is the dynamic viscosity of the fluid. This equation reduces to Rn=(V*D)/v where v is the kinematic viscosity of the fluid Based on the circular configuration of the continuous scupper (155), the maximum Reynolds number for the water foundation (100) is approximately 2300. An important consideration is that the flow rate Q1 from the pump (205) has to be matched to the size of the continuous scupper (155) and the height of the cascade sheet. To maintain laminar flow with a relatively clear circular cascade sheet, the maximum velocity (Vmax) of the falling fluid is a function of the kinematic viscosity of the fluid and the Thickness of the fluid, i.e., Vmax=2300 v/T.

Another equation describes the height Z of the circular cascade sheet. This equation is Z=((X/tan(90−theta))+((½)*g*X^2)/(V^2*sin ^2(90−theta)) where X is the horizontal distance from the wall of the cascade column, theta is the angle between the horizontal and continuous scupper inner edge, and V is the Velocity of the fluid as it exits the continuous scupper inner edge. If X equals or is greater than R (the Radius of the continuous scupper inner edge) then the fluid will collide at the bottom of the circular cascade sheet.

Though calculations may be made to determine whether a laminar flow condition would exist through the circular cascade sheet, determination of laminar flow is also visually detectable by a glassy appearance in the upper basin (105).

Consequently, the size of the components of the water fountain is related. Based on these relationships, the characteristics of certain components have been determined. These characteristics may be used to approximately determine other components. For standardization, model names have been given to certain configurations.

Water Fountain Upper Basin Specifications (Values are Approximate) There is a relationship between the flow rate and the circumference of the continuous scupper as demonstrated by the chart below.

| Fountain Name | Continuous Scupper Circumference at Exit (Inches) | Cascade Height (Inches) |
|---|---|---|
| Vesuvius | 6.28 | 7.5 |
| Tambora | 26.75 | 14 |
| Mauna Loa | 44.5 | 22 |
| Krakatoa | 76 | 19 |
| The Duke | 104 | 40 |

An advantage of the water fountain (100) is that commercial pumps, even pool pumps, may be used.

| Model Name | Approximate Flow Rate GPH | Lower Basin Capacity (gallons) | Cycles per Hour |
|---|---|---|---|
| Vesuvius | 275-300 | 0.75 | 400 |
| Tambora | 1300-1790 | 3 | 433 |
| Mauna Loa | 4500-4900 | 10 | 450 |
| Krakatoa | 7500 | 80 | 93 |
| The Duke | 9100-10000 | 120 | 83 |

Submersing the pump helps to dampen pump vibration and noise as well as to keep the unit self-contained, which allows for easy relocation. Ideally the pump does not touch any part of the structure except through the supply manifold. Dampening the pump vibrations to the structure is helpful, but is not required to for the water fountain to produce a circular cascade sheet.

The water fountain (100) may also be incorporated into nature. Based on an approximate flow rate in a natural waterway of 51,000 GPH and a drop height of 216 inches, the continuous scupper circumference at the cascade chamber edge would be 665 inches.

Figure 7:
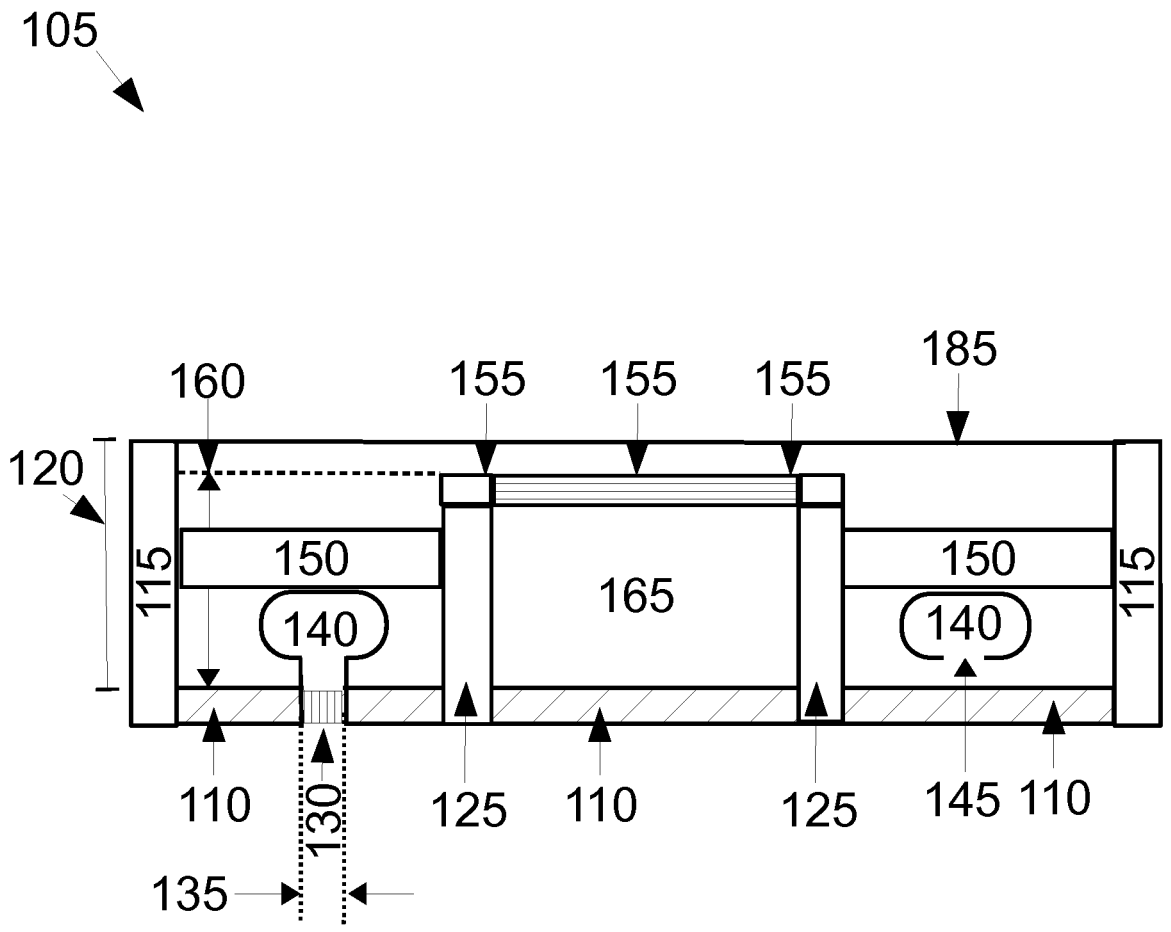
FIG. 7 shows an alternative embodiment of a water fountain with an upper basin top cover.

FIG. 7 shows an embodiment of a water fountain (100) with an upper basin top cover (185). The upper basin top cover (185) seals the upper basin (105) so the fluid does not spill over the upper basin outer wall (115). In this embodiment, the flow rate may be on the upper end of the laminar range.

Figure 8:
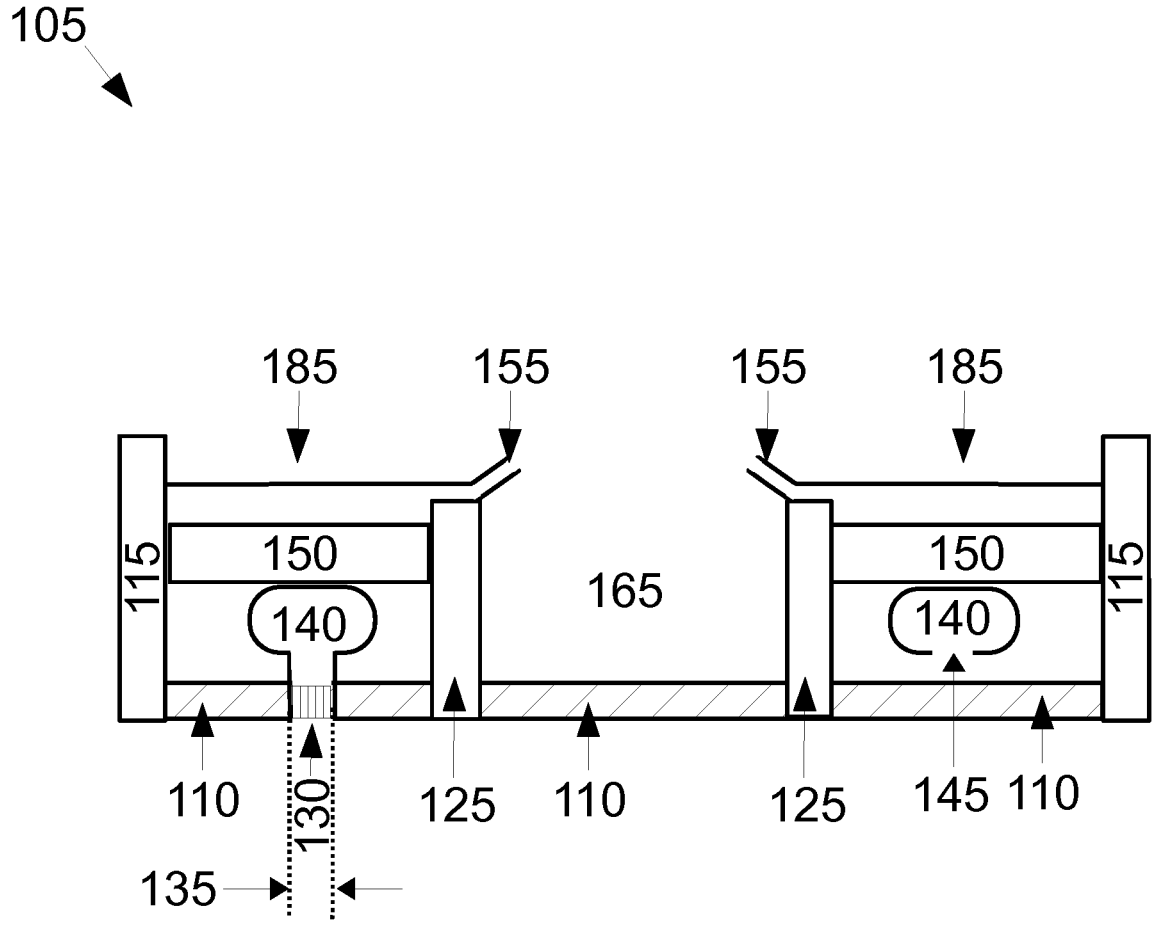
FIG. 8 shows an alternative embodiment of a water fountain with an upper basin top cover and a continuous scupper with a circular outer edge is above the continuous scupper circular lower edge.

FIG. 8 shows an embodiment of a water fountain (100) with an upper basin top cover (185) and a continuous scupper (155) with a circular outer edge is below the continuous scupper inner edge. In this embodiment, a water fountain (100) can send fluid upward to achieve a circular cascade sheet falling from above the upper basin.

Figure 9:
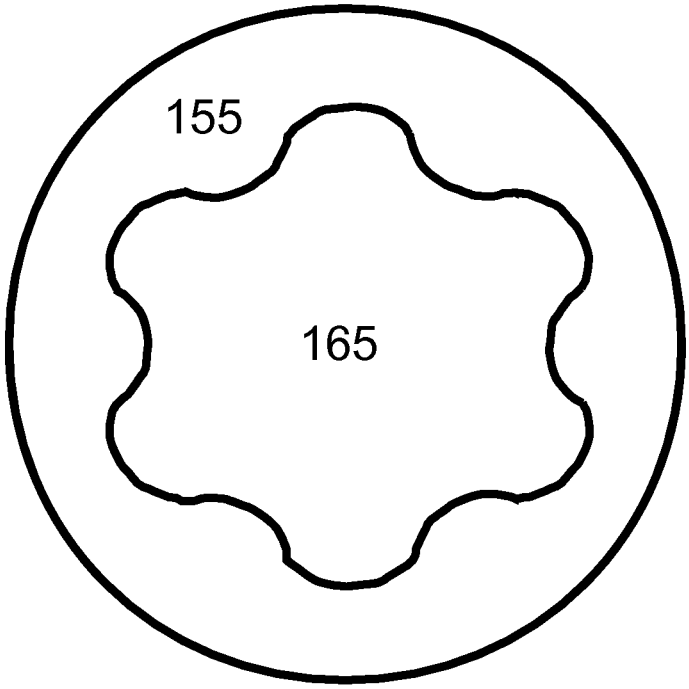
FIG. 9 shows an alternative embodiment of a water fountain with a continuous scupper having alternately inward and outward scalloped edges.

FIG. 9 shows an embodiment of a water fountain (100) of a continuous scupper (155) having alternately inward and outward scalloped edges. In this embodiment, a water fountain can create an intricate circular cascade sheet having multiple semi-circular areas.

The particular implementations shown and described are illustrative of the invention and its best mode and are not intended to otherwise limit the scope of the present invention in any way. Indeed, for the sake of brevity, conventional manufacturing, connection, preparation, and other functional aspects of the system may not be described in detail. Furthermore, the connecting lines shown in the various figures are intended to represent exemplary functional relationships and/or steps between the various elements. Many alternative or additional functional relationships or physical connections may be present in a practical system.

In the foregoing specification, the invention has been described with reference to specific exemplary embodiments. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The invention claimed is:

1. A water fountain that converts turbulent flow of a fluid to laminar flow comprising:

a basin comprising:

a circular inner wall having an upper edge and a lower edge;

an outer wall having an upper edge and a lower edge;

a bottom connecting the lower edge of the circular inner wall to the lower edge of the outer wall; and a longitudinal axis located at a center of the basin;

a fluid distribution port located within the basin above the bottom and between the circular inner wall and the outer wall;

at least one water supply port supplying fluid to the basin and coupled to the fluid distribution port;

a fluid distribution media located within the basin, between the circular inner wall and the outer wall, and above the fluid distribution port, wherein the fluid distribution media is configured to provide a backpressure and flow dispersion to the fluid so that turbulent currents from the fluid distribution port are converted to substantially laminar fluid flows;

a cascade chamber; and an annular scupper located on top of the inner wall and capable of applying a surface tension to the fluid to thin the fluid into a continuous laminar sheet downward in a circular cascade sheet inwardly toward the longitudinal axis and into the cascade chamber.

2. The water fountain of claim 1, wherein the annular scupper is positioned so that the upper edge of the outer wall is higher than a combined height of a thickness of the annular scupper and a height of the inner wall.

3. The water fountain of claim 1, wherein the fluid distribution media is configured to provide backpressure and flow dispersion to the fluid so that a turbulent current exiting the fluid distribution port is converted to laminar flow when flowing over an inner edge of the annular scupper.

4. The water fountain of claim 1, wherein the annular scupper projects inwardly from the inner wall at a distance and is configured to increase conversion of the fluid from turbulent flow to laminar flow.

5. The water fountain of claim 1, wherein the cascade chamber is located inwardly of the circular inner wall of the basin.

6. The water fountain of claim 1, further comprising a fluid distribution ring coupled to the fluid distribution port and located within the basin above the bottom and between the circular inner wall and the outer wall.

7. The water fountain of claim 6, wherein the fluid distribution ring is located below the fluid distribution media.

8. The water fountain of claim 1, further comprising a prescupper positioned adjacent to the annular scupper and the inner wall of the basin.

9. The water fountain of claim 8, wherein the prescupper projects outwardly from the annular scupper and is configured to increase conversion of the fluid from turbulent flow to laminar flow.

10. The water fountain of claim 1, wherein the fluid distribution media comprises at least one sieve.

11. The water fountain of claim 1 wherein the fluid distribution media comprises filter media.

12. The water fountain of claim 1, wherein the fluid distribution port comprises a plurality of fluid distribution ports.

13. The water fountain of claim 1, wherein an inner edge of the annular scupper comprises alternating inward and outward scalloped edges.

14. The water fountain of claim 1, wherein an inner edge of the annular scupper comprises alternately inward and outward scalloped edges and alternately upward and downward scalloped edges.

15. The water fountain of claim 1, wherein an inner edge of the annular scupper comprises a triangular tip.

16. The water fountain of claim 1, wherein an inner edge of the annular scupper comprises a notch tip.

17. The water fountain of claim 1, wherein the at least one water supply port extends through the bottom of the basin and is coupled to the fluid distribution port.

18. A water fountain that converts turbulent flow of a fluid to laminar flow comprising:

a basin comprising:

a circular inner wall having an upper edge and a lower edge;

an outer wall having an upper edge and a lower edge;

a bottom connecting the lower edge of the circular inner wall to the lower edge of the of the outer wall; and a longitudinal axis located at a center of the basin;

a fluid distribution ring located within the basin above the bottom and between the circular inner wall and the outer wall;

at least one water supply port extending through the bottom of the basin and coupled to the fluid distribution ring;

a fluid distribution port coupled to the fluid distribution ring and located within the basin above the bottom and between the circular inner wall and the outer wall;

a fluid distribution media located within the basin, between the circular inner wall and the outer wall, and above the fluid distribution port, wherein the fluid distribution media is configured to provide a backpressure and flow dispersion to the fluid so that turbulent currents from the fluid distribution port are converted to substantially laminar fluid flows;

a cascade chamber; and an annular scupper located on top of the inner wall and capable of applying a surface tension to the fluid to thin the fluid into a continuous laminar sheet downward in a circular cascade sheet inwardly toward the longitudinal axis and into the cascade chamber.

19. The water fountain of claim 18, wherein the fluid distribution ring is located below the fluid distribution filter.

20. The water fountain of claim 18, wherein the fluid distribution port comprises a plurality of fluid distribution ports.

21. The water fountain of claim 18, wherein the fluid distribution media is configured to provide backpressure and flow dispersion to the fluid so that a turbulent current exiting the fluid distribution port is converted to laminar flow when flowing over an inner edge of the annular scupper.

22. A water fountain that converts turbulent flow of a fluid to laminar flow comprising:

a basin comprising:

a circular inner wall having an upper edge and a lower edge;

an outer wall having an upper edge and a lower edge;

a bottom connecting the lower edge of the circular inner wall to the lower edge of the outer wall; and a longitudinal axis located at a center of the basin;

a fluid distribution port located within the basin above the bottom and between the circular inner wall and the outer wall;

at least one water supply port supplying fluid to the basin and coupled to the fluid distribution port;

a fluid distribution media located within the basin, wherein the fluid distribution media is configured to provide a backpressure and flow dispersion to the fluid so that turbulent currents from the fluid distribution port are converted to substantially laminar fluid flows;

a cascade chamber; and an annular scupper located on top of the inner wall and capable of applying a surface tension to the fluid to thin the fluid into a continuous laminar sheet downward and inwardly toward the longitudinal axis and in a circular cascade sheet into the cascade chamber, wherein the annular scupper is positioned so that the upper edge of the outer wall is higher than a combined height of a thickness of the annular scupper and a height of the inner wall.

* * * * *